US008687993B2

(12) United States Patent
Honobe et al.

(10) Patent No.: US 8,687,993 B2
(45) Date of Patent: Apr. 1, 2014

(54) CHARGING DEVICE, IMAGE FORMING ASSEMBLY AND IMAGE FORMING APPARATUS USING THE CHARGING DEVICE

(75) Inventors: Satoshi Honobe, Kanagawa (JP); Hiroki Ando, Kanagawa (JP); Tsuneo Fukuzawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 215 days.

(21) Appl. No.: 13/204,396

(22) Filed: Aug. 5, 2011

(65) Prior Publication Data

US 2012/0207506 A1 Aug. 16, 2012

(30) Foreign Application Priority Data

Feb. 15, 2011 (JP) ..... 2011-029921

(51) Int. Cl.
*G03G 15/02* (2006.01)

(52) U.S. Cl.
CPC ..... *G03G 15/0216* (2013.01)
USPC ..... 399/89; 399/115

(58) Field of Classification Search
USPC ..... 399/89, 90, 115
See application file for complete search history.

(56) References Cited

U.S. PATENT DOCUMENTS

| | | | | |
|---|---|---|---|---|
| 5,532,795 | A * | 7/1996 | Tatsumi et al. | 399/170 |
| 5,873,019 | A * | 2/1999 | Mizuishi | 399/313 |
| 6,064,841 | A * | 5/2000 | Matsuzaki et al. | 399/90 |
| 2011/0069989 | A1 * | 3/2011 | Kim | 399/115 |

FOREIGN PATENT DOCUMENTS

| | | | |
|---|---|---|---|
| JP | 11-231721 | A | 8/1999 |
| JP | 2007-133121 | A | 5/2007 |
| JP | 2008-281841 | A | 11/2008 |

* cited by examiner

*Primary Examiner* — Walter L Lindsay, Jr.
*Assistant Examiner* — Philip Marcus T Fadul
(74) *Attorney, Agent, or Firm* — Sughrue Mion, PLLC

(57) ABSTRACT

A charging device includes a charging member in contact with or adjacent to a charged body, a charge housing that holds the charging member, bearing members that rotatably support the charging member, at least one of the bearing members being a conductive bearing member, pressing members that press the bearing members toward the charged body, at least the pressing member for the conductive bearing member being formed of a conductive material, a platelike power supply member in contact with the pressing member for the conductive bearing member, and positioning mechanisms that position the bearing members. The power supply member has a platelike extending portion. The positioning mechanism provided on a power supplied side of the charging member includes a positioning portion provided in the conductive bearing member, and a positioned portion provided in the extending portion. The positioned portion engages with the positioning portion when the extending portion elastically deforms.

7 Claims, 17 Drawing Sheets

CHARGING DEVICE, IMAGE FORMING ASSEMBLY AND IMAGE FORMING APPARATUS USING THE CHARGING DEVICE

CROSS-REFERENCE TO RELATED APPLICATIONS

This application is based on and claims priority under 35 USC 119 from Japanese Patent Application No. 2011-029921 filed Feb. 15, 2011.

BACKGROUND (i) Technical Field

The present invention relates to a charging device, and an image forming assembly and an image forming apparatus using the charging device.

(ii) Related Art

Various charging devices of such a type have been disclosed hitherto.

SUMMARY

According to an aspect of the invention, there is provided a charging device including a charging member opposing a charged body to be charged, the charging member being provided in contact with or adjacent to the charged body; a charge housing that holds the charging member; bearing members provided in the charge housing to rotatably support both axial ends of the charging member, at least one of the bearing members being a conductive bearing member formed of a conductive material; pressing members provided in the charge housing to press the bearing members toward the charged body, at least the pressing member that presses the conductive bearing member being formed of a conductive material; a substantially platelike power supply member fixed to the charge housing and provided in contact with the pressing member corresponding to the conductive bearing member so as to supply power to the charging member via the pressing member and the conductive bearing member; and positioning mechanisms that position the bearing members pressed by the pressing members at a predetermined holding position relative to the charge housing so that the bearing members do not fall off. The power supply member has an elastically deformable and substantially platelike extending portion extending to a position opposing the conductive bearing member. The positioning mechanism provided on a power supplied side of the charging member includes a substantially depressed or projecting positioning portion provided in a portion of the conductive bearing member opposing the extending portion, and a substantially projecting or depressed positioned portion provided in a portion of the extending portion corresponding to the positioning portion, the positioned portion engaging with the positioning portion when the extending portion elastically deforms.

BRIEF DESCRIPTION OF THE DRAWINGS

Exemplary embodiments of the present invention will be described in detail based on the following figures, wherein.

DETAILED DESCRIPTION

Outline of Exemplary Embodiment

Figure 1A:
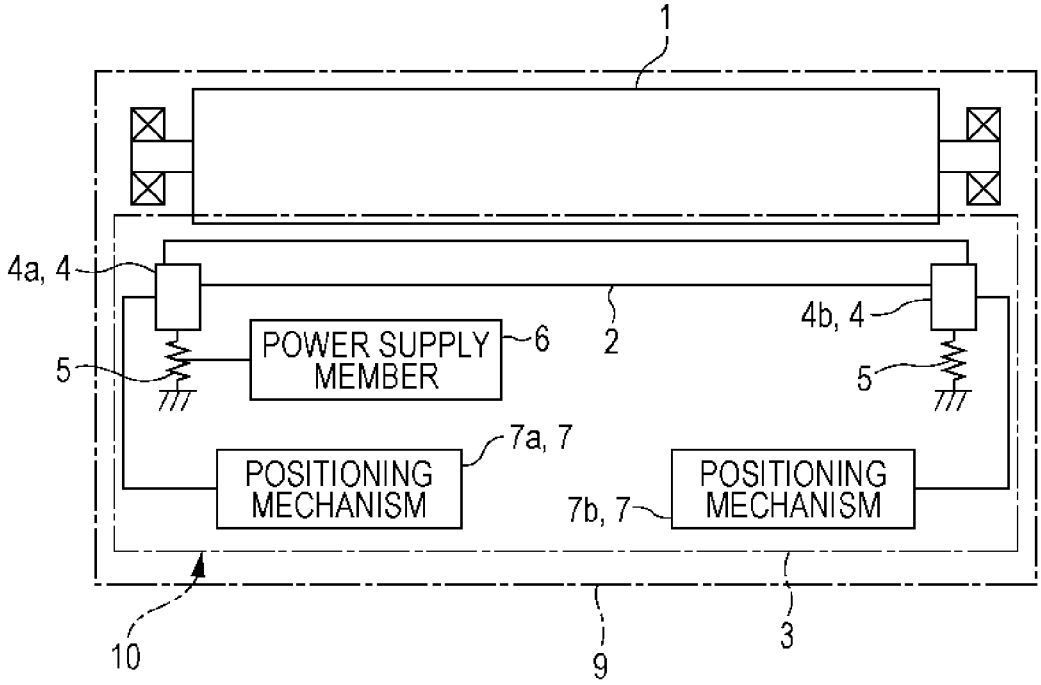
FIG. 1A schematically illustrates a charging device, and an image forming assembly and an image forming apparatus using the charging device according to an exemplary embodiment of the present invention, and FIG. 1B schematically illustrates a positioning mechanism located on a power supplied side of the charging device of FIG. 1A.
Figure 1B:
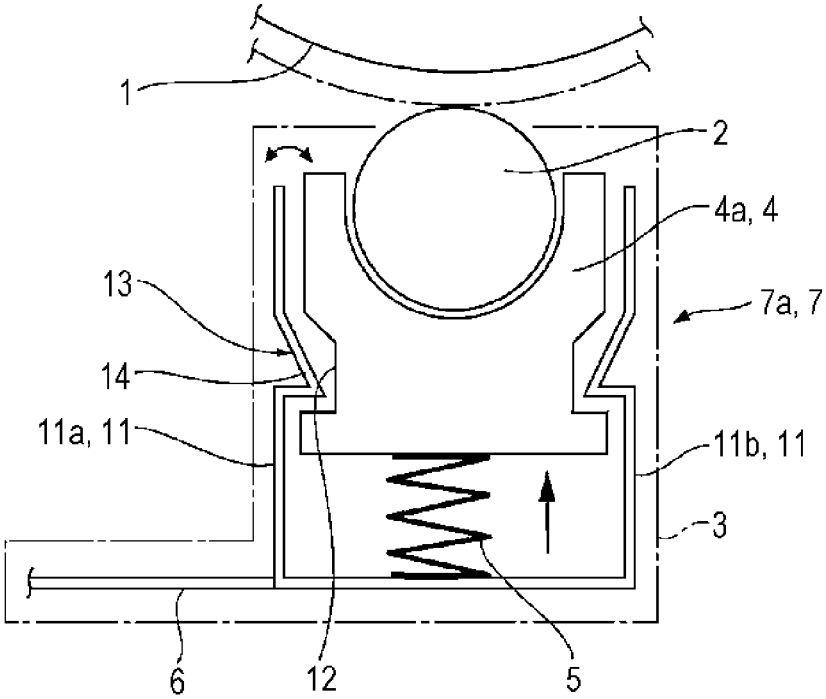

FIGS. 1A and 1B schematically illustrate a charging device, and an image forming assembly and an image forming apparatus using the charging device according to a first exemplary embodiment of the present invention.

Referring to FIG. 1A, the image forming apparatus includes a charged body 1 to be charged to form an image, and a charging device 10 that charges the charged body 1.

In an image forming apparatus of such a type, components are sometimes discretely provided, whereas an image forming assembly in which components are assembled is sometimes detachably mounted in an image forming apparatus housing. In this case, for example, the image forming assembly includes the charged body 1 to be charged to form an image, the charging device 10 that charges the charged body 1, and a housing 9 that includes a charge housing 3 of the charging device 10 and that holds the charged body 1. The image forming assembly is detachably mounted in the image forming apparatus housing. Thus, it is satisfactory as long as the image forming assembly holds the charged body 1 to be charged, such as a photoconductor or a dielectric body, and the charging device 10 for charging the charged body 1 at least in the housing 9 (including the charge housing 3). Of course, the image forming assembly may include other elements such as a cleaning device for cleaning the charged body 1 and an optical component for writing an electrostatic latent image on the charged body 1.

As illustrated in FIGS. 1A and 1B, the charging device 10 of the exemplary embodiment includes a charging member 2, a charge housing 3, bearing members 4 (4*a*, 4*b*), pressing members 5, a platelike or substantially platelike power supply member 6, and positioning mechanisms 7 (7*a*, 7*b*). The charging member 2 opposes the charged body 1 in contact with or close to the charged body 1. The charge housing 3 holds the charging member 2. The bearing members 4 are provided in the charge housing 3 to rotatably support both axial ends of the charging member 2. At least one of the bearing members 4 is a conductive bearing member 4*a* formed of a conductive material. The pressing members 5 are provided in the charge housing 3 to press the bearing members 4 against the charged body 1. At least the pressing member 5 for pressing the conductive bearing member 4*a* is formed of a conductive material. The power supply member 6 is fixed to the charge housing 3 and is in contact with the pressing member 5 corresponding to the conductive bearing member 4*a* so as to supply power to the charging member 2 via the pressing member 5 and the conductive bearing member 4*a*. The positioning mechanisms 7 hold the bearing members 4, which are pressed by the pressing members 5, at predetermined holding positions with respect to the charge housing 3 so that the bearing members 4 do not fall off. The power supply member 6 includes an elastically deformable and platelike or substantially platelike extending portion (e.g., 11*a*, 11*b*) extending to a portion opposing the conductive bearing member 4*a*. The positioning mechanism 7*a* provided on the power supplied side of the charging member 2 includes a depressed or projecting or substantially depressed or projecting positioning portion 12 provided in a portion of the conductive bearing member 4*a* opposing the extending portion 11, and a projecting or depressed or substantially projecting or depressed positioned portion 13 provided in a portion of the extending portion 11 corresponding to the positioning portion 12. The positioned portion 13 engages with the positioning portion 12 when the extending portion 11 deforms elastically.

In such a structure, the charging member 2 may be provided adjacent to the charged body 1, instead of being in contact therewith. When the charging member 2 is adjacent to the charged body 1, the position of the charging member 2 is regulated by a regulating member separately provided to regulate the positional relationship between the charging member 2 and the charged body 1.

Further, it is satisfactory as long as the charge housing 3 holds the charging member 2. For example, the charge housing 3 may be shaped like a box that stores the charging member 2, or may be formed by a frame member having a holding frame.

Further, at least one of the bearing members 4 needs to serve as the conductive bearing member 4*a* formed of a conductive material. In general, while the bearing members 4 may be formed of an arbitrary material, they are frequently formed of synthetic resin having elasticity (e.g., POM: polyacetal, polyoxymethylene) because its ease of production. The conductive bearing member 4*a* may be obtained by imparting conductivity to the material of the bearing members 4. Typically, the conductive bearing member 4*a* is formed of synthetic resin containing a conductive material such as carbon.

Further, the pressing member 5 in contact with the conductive bearing member 4*a* on the power supplied side may be formed of an appropriate material such as a conductive spring member or elastic member. The pressing member 5 is positioned relative to the charge housing 3 so as to maintain a good contact between the pressing member 5 and the power supply member 6.

In addition, it is satisfactory as long as the power supply member 6 includes a platelike or substantially platelike power supply member. A power supply member, such as a conductor wire, may be connected to the platelike or substantially platelike power supply member.

It is also satisfactory as long as the power supply member 6 includes the extending portion 11 extending to the position opposing the conductive bearing member 4*a*. The extending portion 11 is shaped like an elastically deformable and platelike or substantially platelike member. At least one extending portion 11 is provided, and plural extending portions (11*a*, 11*b*) may be provided.

As the positioning mechanism 7*a* on the power supplied side, the conductive bearing member 4*a* is provided with the positioning portion 12, and the corresponding extending portion 11 is provided with the positioned portion 13. The positioning portion 12 has a substantially depressed or projecting shape, and the positioned portion 13 has a substantially projecting or depressed shape such as to engage with the positioning portion 12. Here, the substantially projecting shape refers to a shape projecting from a reference surface, and the substantially depressed shape refers to a shape depressed from the reference surface. The substantially depressed shape includes not only a bottomed recess, but also a through-hole.

Next, a description will be given of typical examples used in the exemplary embodiment.

First, plural extending portions 11 (11*a*, 11*b*) are provided to oppose the conductive bearing member 4*a*, and positioning mechanisms 7*a* corresponding to the conductive bearing member 4*a* are provided between the extending portions 11 (11*a*, 11*b*) and the conductive bearing member 4*a*. While the arrangement of the positioning mechanisms 7*a* may be appropriately determined in this example, the plural extending portions 11 (11*a*, 11*b*) are arranged with the conductive bearing member 4*a* being disposed therebetween and the positioning mechanisms 7*a* are also provided with the conductive bearing member 4*a* being disposed therebetween, in order to more stably position the charging member 2.

As typical examples of positioning mechanisms 7*a* on the power supplied side of the charging member 2, the conductive bearing member 4*a* has depressed or substantially depressed positioning portions 12, and the extending portions 11 have projecting or substantially projecting positioned portions 13. In this example, since the extending portions 11 are formed by elastically deformable and platelike or substantially platelike members using parts of the power supply member 6, the projecting positioned portions 13 may be easily formed in the extending portions 11. In contrast, the depressed positioning portions 12 may also be easily formed in the conductive bearing member 4*a*, for example, by partially cutting an existing conductive bearing member 4*a*.

In a typical example, the projecting positioned portions 13 are projecting pieces 14 formed by folding parts of the extending portions 11 in an angular form. This example may be obtained by folding parts of the platelike or substantially platelike extending portions 11.

In examples of such projecting positioned portions 13, the inclination angle of portions of the projecting pieces 14, which form the projecting positioned portions 13, on a side to be pressed by the pressing member 5 with respect to the pressing direction of the pressing member 5 is set to be smaller than that of portions on an opposite side. While the projecting pieces 14 that form the positioned portions 13 are folded in an angular form in this example, assembly workability of the conductive bearing member 4*a* may be ensured by decreasing the resistance of the conductive bearing member 4*a* during insertion in the assembly direction in the portions of the angular projecting pieces (portions having a smaller inclination angle), and positioning performance may be ensured by improving engagement with the depressed positioning portions 12 in the other portions (portions having a larger inclination angle). The larger inclination angle may be a substantially right angle.

In another example of a positioning mechanism 7*a* on the power supplied side of the charging member 2, when the charging member 2 is located in contact with or adjacent to the charged body 1, the positioning portions 12 and the positioned portions 13 are in contact with each other in a direction intersecting the pressing direction of the pressing member 5. In this example, when the charging member 2 is provided at a position to supply power to the charged body 1, a second power supply contact is added to a power supply contact between the power supply member 6 and the pressing member 5.

A typical example of a positioning mechanism 7*b* provided on a power non-supplied side of the charging member 2 includes an elastically deformable and projecting or substantially projecting positioning portion (not illustrated) provided in a part of the bearing member 4*b*, and a depressed or substantially depressed positioned portion (not illustrated) provided in a part of the charge housing 3 corresponding to the positioning portion. The positioned portion engages with the positioning portion when the positioning portion elastically deforms. While the positioning mechanism 7*b* provided on the power non-supplied side of the charging member 2 may be similar to that of the related art, the bearing member 4*b* may be formed of a synthetic resin material having high durability and elasticity. This is because the structure of the exemplary embodiment in which the projecting positioning portion is provided on the bearing member 4*b* achieves easy positioning by efficiently utilizing elasticity while ensuring durability of the material of the bearing member 4*b*. In a structure in which the projecting positioning portion is provided in the charge housing 3, if it is difficult to ensure a sufficient elasticity of the charge housing 3, positioning with the positioning mechanism 7*b* may be difficult.

First Exemplary Embodiment

Overall Configuration of Image Forming Apparatus

Figure 2:
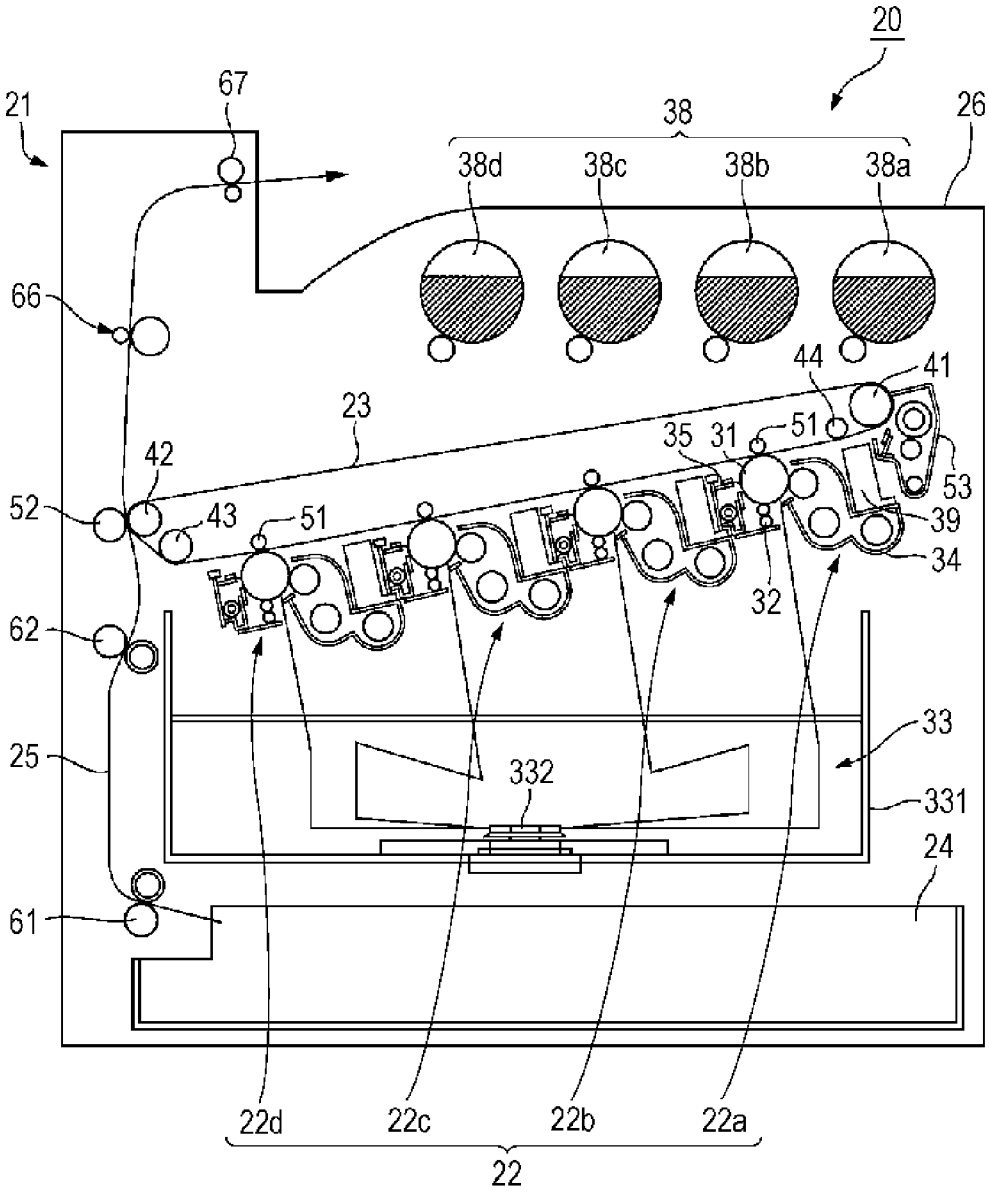
FIG. 2 illustrates an overall configuration of an image forming apparatus according to a first exemplary embodiment.
Figure 3:
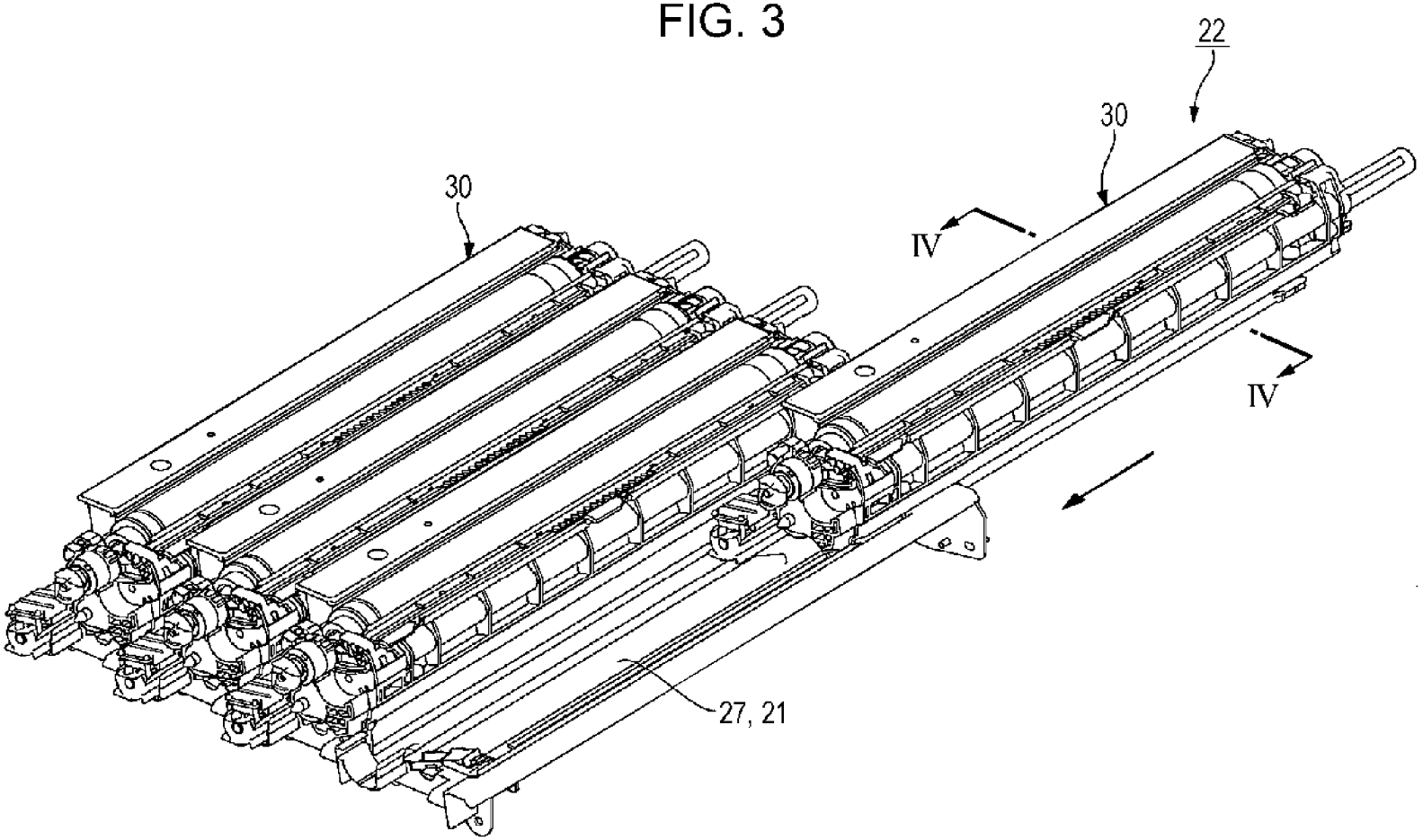
FIG. 3 is an overall perspective view of image forming sections used in the first exemplary embodiment.

FIG. 2 illustrates an overall configuration of an image forming apparatus 20 according to a first exemplary embodiment.

In the image forming apparatus 20 illustrated in FIG. 2, image forming sections 22 (22*a* to 22*d*) corresponding to four colors (yellow, magenta, cyan, and black in the exemplary embodiment) are provided in an image forming apparatus housing (hereinafter referred to as an apparatus housing) 21. The image forming sections 22 are arranged along a line that slightly slopes upward from the horizontal direction. Above the image forming sections 22, an intermediate transfer belt 23 is provided to rotate in an arrangement direction in which the image forming sections 22 are arranged. A recording-material supply device 24 that stores and supplies recording materials is provided at the bottom of the apparatus housing 21, and a recording-material output receiver 26 that receives output image-formed recording materials is provided at the top of the apparatus housing 21. A recording material supplied from the recording-material supply device 24 is output into the recording-material output receiver 26 through a recording-material transport path 25 extending in a vertical direction.

In the first exemplary embodiment, for example, the image forming sections 22 (22*a* to 22*d*) form toner images of yellow, magenta, cyan, and black in order from the upstream side in the rotating direction of the intermediate transfer belt 23 (the order is not particularly limited). Each of the image forming sections 22 includes a photoconductor 31, for example, shaped like a drum, a charging device 32 that charges the photoconductor 31 beforehand, an exposure device 33 that writes an electrostatic latent image on the photoconductor 31 charged by the charging device 32, a developing device 34 that develops the electrostatic latent image on the photoconductor 31 with color toners into visual toner images, and a cleaning device 35 that cleans off residual toner from the photoconductor 31.

The exposure device 33 is commonly used for all image forming sections 22. In an exposure container 331 of the exposure device 33, an optical image including a color component from a light source such as a semiconductor laser (not illustrated) is deflected and scanned by a deflecting mirror 332, and is guided to an exposure position on the corresponding photoconductor 31 via an imaging lens and a mirror (not illustrated).

The intermediate transfer belt 23 is stretched around tension rollers 41 to 44, and is rotated, for example, by the tension roller 41 serving as a driving roller. On a back side of the intermediate transfer belt 23, primary transfer devices 51 (e.g., primary transfer rollers) are provided in correspondence with the photoconductors 31. By applying, to the primary transfer devices 51, a voltage having a polarity opposite the toner charging polarity, toner images on the photoconductors 31 are electrostatically transferred onto the intermediate transfer belt 23.

A secondary transfer device 52 (e.g., a secondary transfer roller) is provided at a position corresponding to the tension roller 42 located downstream of the most downstream image forming section 22*d* in the moving direction of the intermediate transfer belt 23. The secondary transfer device 52 secondarily transfers (collectively transfers) the primary transfer images on the intermediate transfer belt 23 onto a recording material.

An intermediate cleaning device 53 for cleaning off residual toner from the intermediate transfer belt 23 is provided at a position corresponding to the tension roller 41 that is located downstream of the secondary transfer position on the intermediate transfer belt 23.

The intermediate transfer belt 23 is formed of resin such as polyimide, polycarbonate, polyester, or polypropylene, or rubber containing an appropriate quantity of antistatic agents such as carbon black. The intermediate transfer belt 23 has a volume resistivity of $10^6$ to $10^{14}$ Ωcm.

In the first exemplary embodiment, a recording material fed out by a feeder 61 in the recording-material supply device 24 is transported by an appropriate number of transport rollers (not illustrated) provided in the recording-material transport path 25, and is registered by registration rollers 62. Then, the recording material passes through the secondary transfer portion of the secondary transfer device 52, and an unfixed toner image is fixed thereon with heat and pressure by a fixing device 66. After that, the recording material is output and received in the recording-material output receiver 26 via output rollers 67.

In FIG. 2, developer containers 38 (38*a* to 38*d*) resupply new developer (toner in the exemplary embodiment) to the developing devices 34 in the image forming sections 22 (22*a* to 22*d*).

Image Forming Sections

In the first exemplary embodiment, as illustrated in FIGS. 3 to 7, each of the image forming sections 22 (22*a* to 22*d*) is formed as a process cartridge 30 serving as an image forming assembly in which plural functional elements are combined. The process cartridge 30 is detachably mounted in a cartridge receiving portion 27 of the apparatus housing 21.

Figure 4:
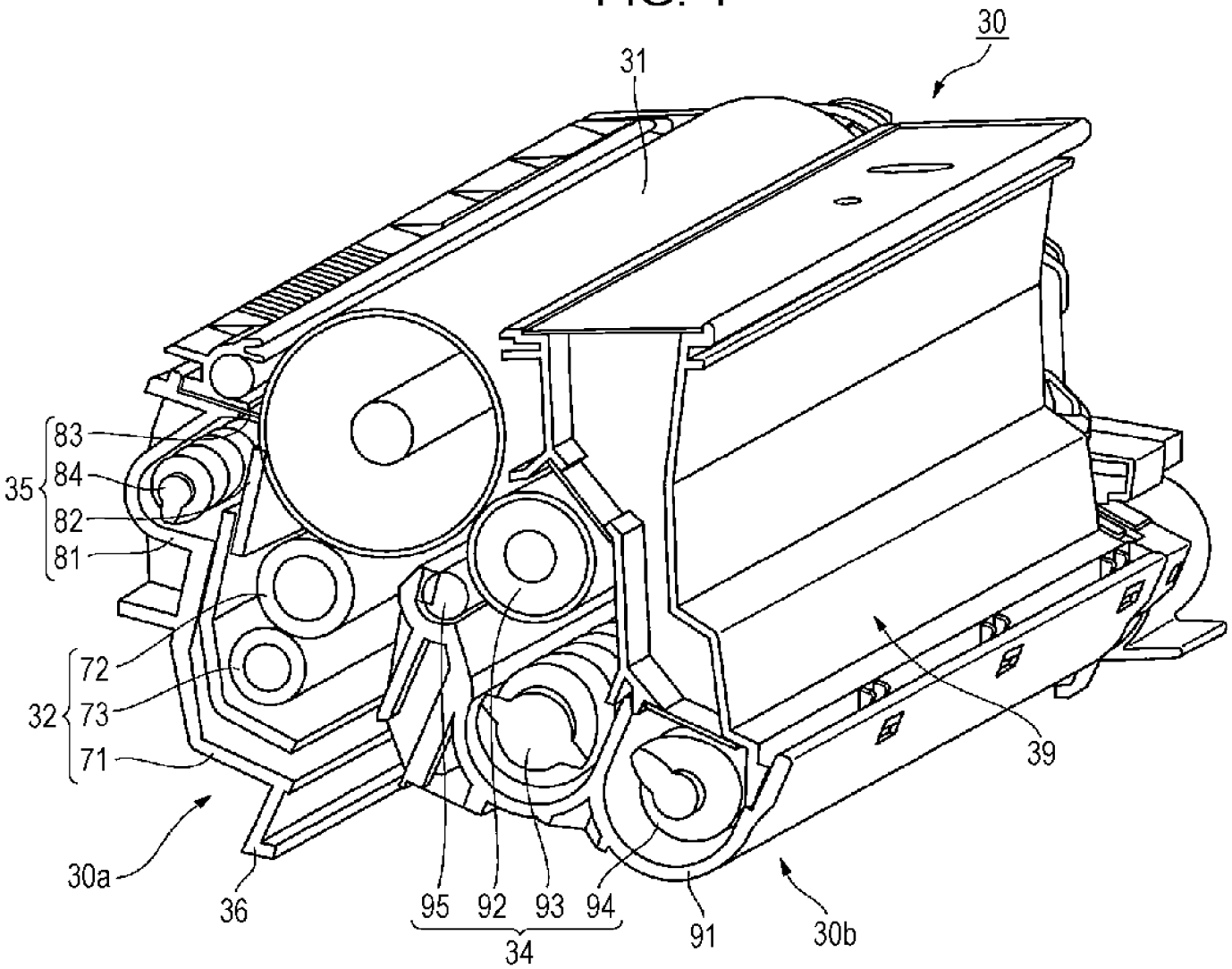
FIG. 4 is a partial cross-sectional perspective view of a process cartridge used in the first exemplary embodiment, taken along line IV-IV of FIG. 3.
Figure 5:
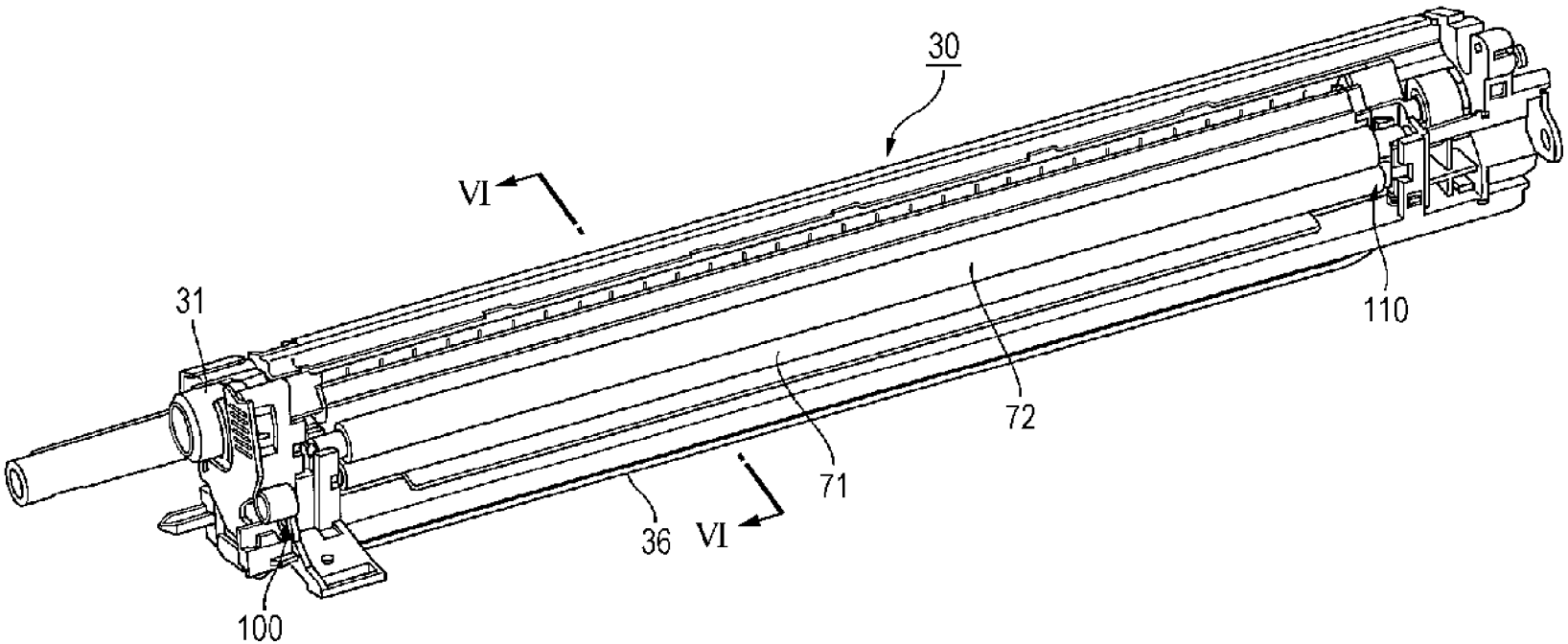
FIG. 5 illustrates the process cartridge from which a developing cartridge is removed.

In the first exemplary embodiment, as illustrated in FIG. 4, the process cartridge 30 includes a photoconductor cartridge 30*a* and a developing cartridge 30*b*. In the photoconductor cartridge 30*a*, the photoconductor 31, the charging device 32 for charging the photoconductor 31, and the cleaning device 35 for cleaning the photoconductor 31 are assembled in a common housing 36. The developing cartridge 30*b* is positioned relative to the photoconductor cartridge 30*a*, and incorporates the developing device 34 for developing an electrostatic latent image on the photoconductor 31.

As illustrated in FIG. 4, the charging device 32 serving as an element of the photoconductor cartridge 30*a* includes a charge housing 71 having an open portion opposing the photoconductor 31 and formed integrally with the housing 36. In the charge housing 71, a charging roller 72 provided in contact with or adjacent to a surface of the photoconductor 31, and a cleaning roller 73 for cleaning the charging roller 72 are provided.

Further, as illustrated in FIG. 4, the cleaning device 35 includes a cleaning container 81 having an open portion opposing the photoconductor 31 and integrally formed with the housing 36. At one side of the open portion of the cleaning container 81 extending in the longitudinal direction, a cleaning member 82 formed by an elastic scraper plate extends in contact with the photoconductor 31. At the other side of the open portion of the cleaning container 81 extending in the longitudinal direction, an elastic sealing member 82 extends in contact with the photoconductor 31. In the cleaning container 81, a transport member 84 is provided to discharge residues, such as toner, scraped by the cleaning member 82 to the outside of the cleaning container 81 in the longitudinal direction.

In contrast, the developing device 34 serving as an element of the developing cartridge 30*b* includes a developing container 91 that has an open portion opposing the photoconductor 31 and that stores toner and carriers. A developing roller 92 capable of holding developer is provided at a position opposing the open portion of the developing container 91. In a portion of the developing container 91 on the back side of the developing roller 92, agitating transport members 93 and 94 are provided to agitate, circulate, and transport developer. In addition, a layer-thickness regulating member 95 is provided at a position opposing the developing roller 92 so as to regulate the thickness of a layer of developer that is held on the developing roller 92. An initial developer storage container 39 puts initial developer into the developing device 34 at the beginning of use.

Support Structure and Power Supply Structure for Charging Device

Next, a description will be given of a support structure and a power supply structure for the charging device with reference to FIGS. 6 to 14.

In the charging device 32 of the first exemplary embodiment, as described above, the charging roller 72 and the cleaning roller 73 are held in the charge housing 71. The charging roller 72 and the cleaning roller 73 are rotatably supported at both axial ends by bearing members 100 and 110. The bearing members 100 and 110 are each pressed toward the photoconductor 31 by a pressing member 120. In the first exemplary embodiment, a charging bias and a cleaning bias are applied to the charging roller 72 and the cleaning roller 73, respectively, via one of the bearing members, that is, the bearing member 100. The charge housing 71 is formed of an insulating synthetic resin (e.g., ABS resin).

Bearing Member on Power Supplied Side

First, the bearing member 100 on the power supplied side will be described with reference to FIGS. 6 to 10.

In the first exemplary embodiment, the bearing member 100 on the power supplied side is formed of a conductive material, for example, a synthetic resin containing a conductive material such as carbon (e.g., POM: polyacetal, polyoxymethylene).

The bearing member 100 has, in a portion opposing the photoconductor 31, a first bearing portion 101 shaped like a substantially U-shaped groove in which one axial end of the charging roller 72 is supported. The bearing member 100 also has, on a pressing member 120 side of the first bearing portion 101, a second bearing portion 102 shaped like a hole in which one axial end of the cleaning roller 73 is fitted and supported. From axial ends of the bearing portions 101 and 102 at one side, elastically deformable block pieces 103 and 104 integrally stand to block tips of the axial ends of the charging roller 72 and the cleaning roller 73.

In addition, in the first exemplary embodiment, the pressing member 120 is formed by an elastic spring, such as a coil spring, for example. For this reason, a connecting pin 105 protrudes from a pressing member 120 side of the bearing member 100, and one end of the pressing member 120 is fitted on and connected to the connecting pin 105. The other end of the pressing member 120 is fitted on a restraint pin 121 protruding from the charge housing 71 so that the pressing member 120 is restrained from being displaced from a predetermined position.

Power Supply Structure

Figure 6:
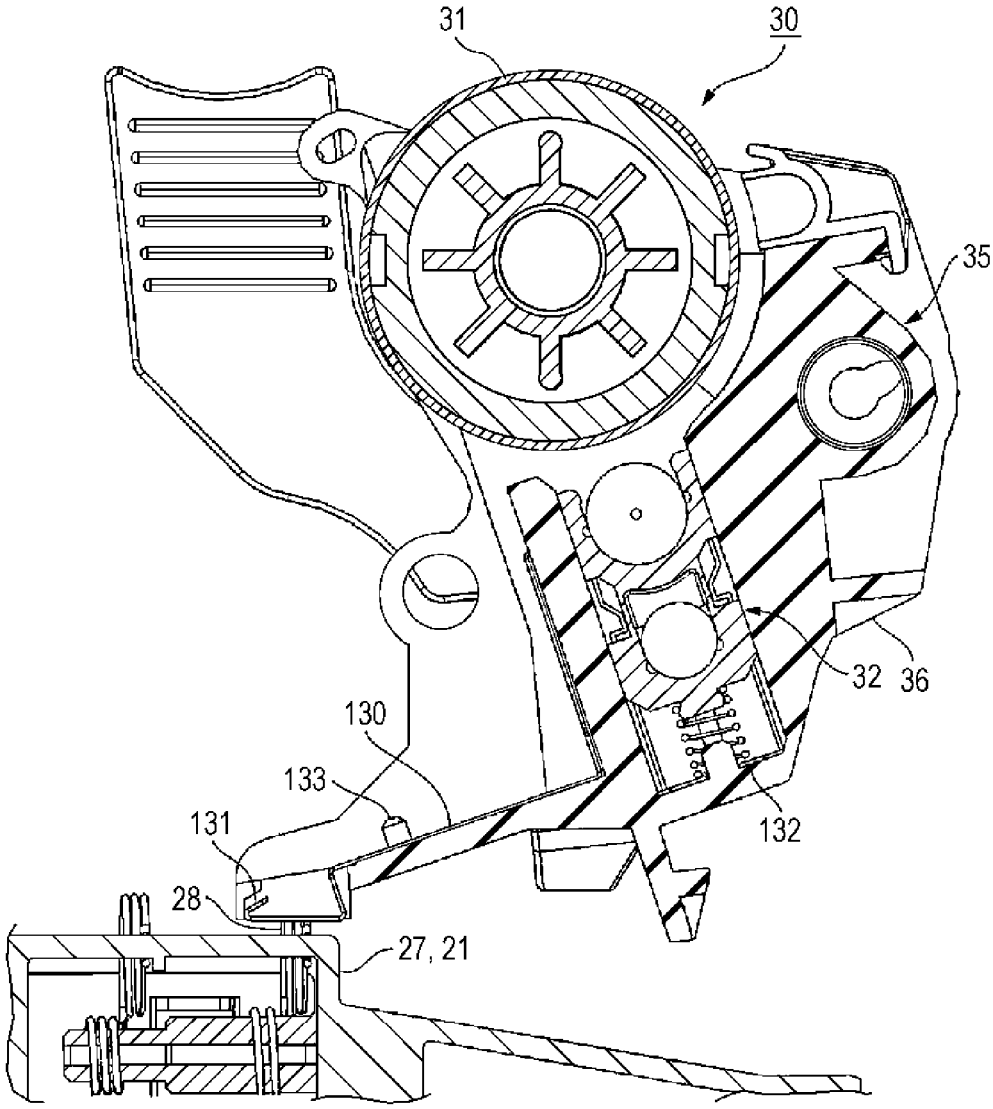
FIG. 6 is a cross-sectional view of the process cartridge used in the first exemplary embodiment, taken along line VI-VI.
Figure 7:
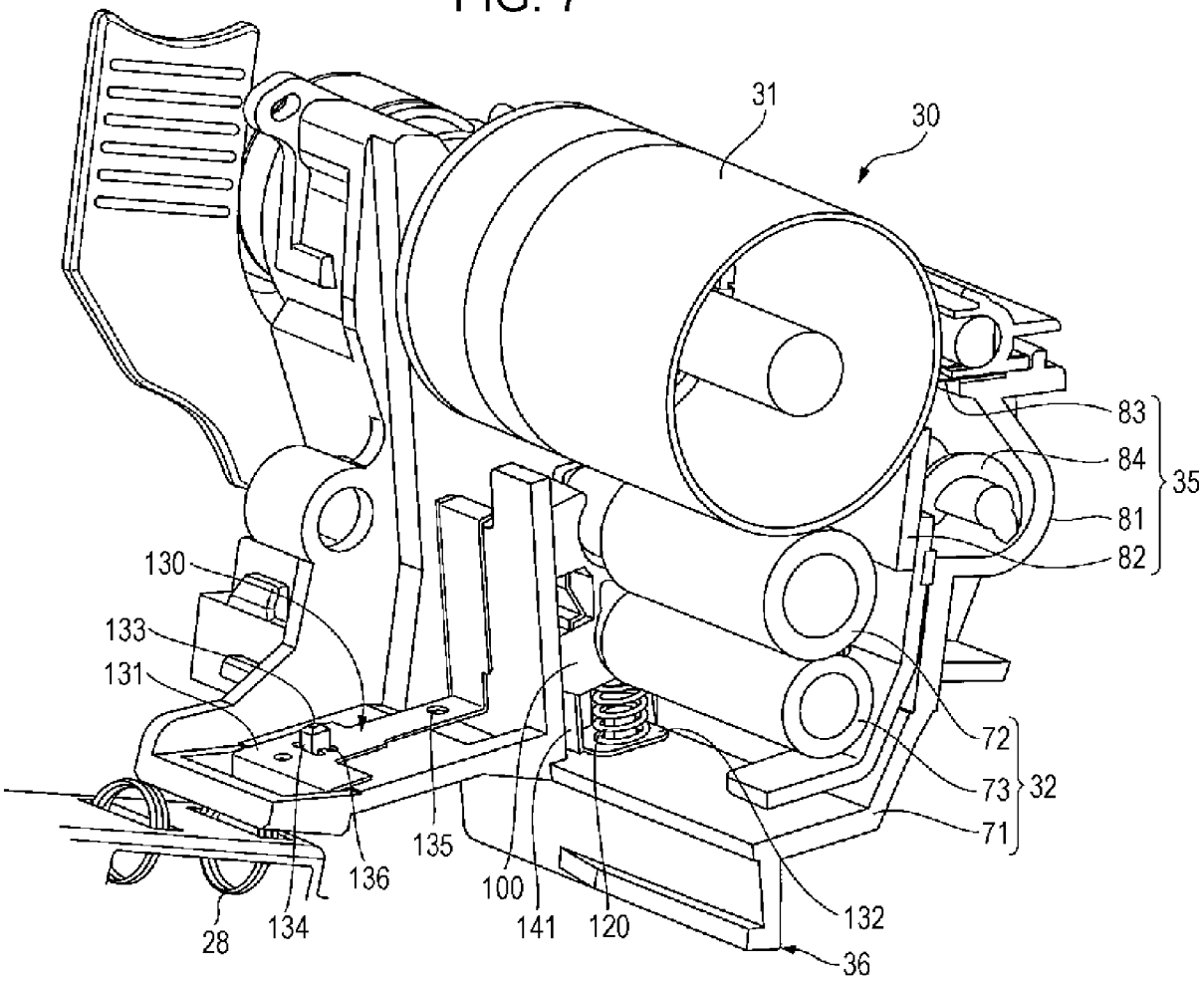
FIG. 7 is a partial perspective view illustrating a power supply structure and a support structure for a charging device in the process cartridge of FIG. 6.
Figure 8:
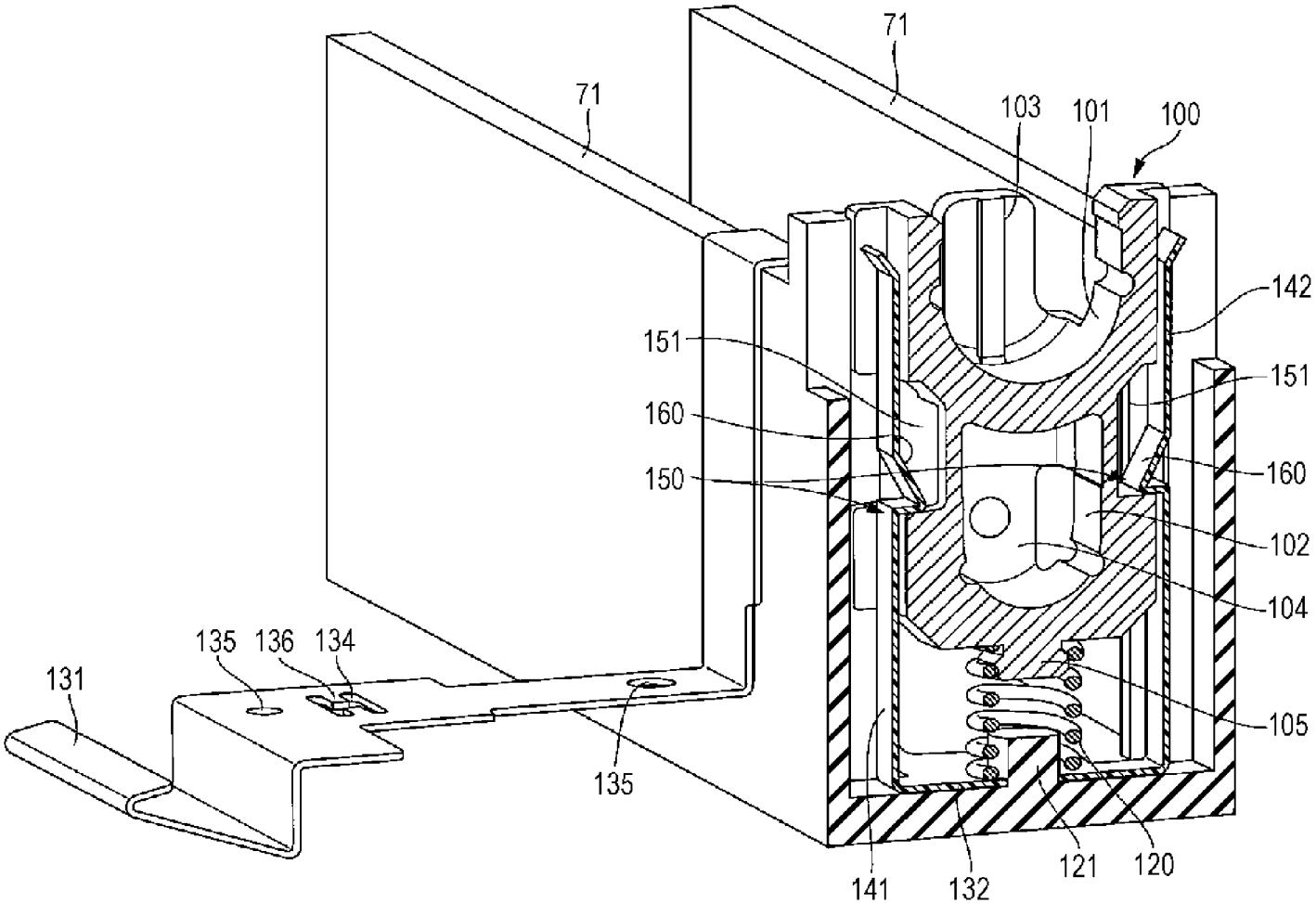
FIG. 8 is a cross-sectional view illustrating the principal parts of the power supply structure and the support structure for the charging device used in the first exemplary embodiment.
Figure 9:
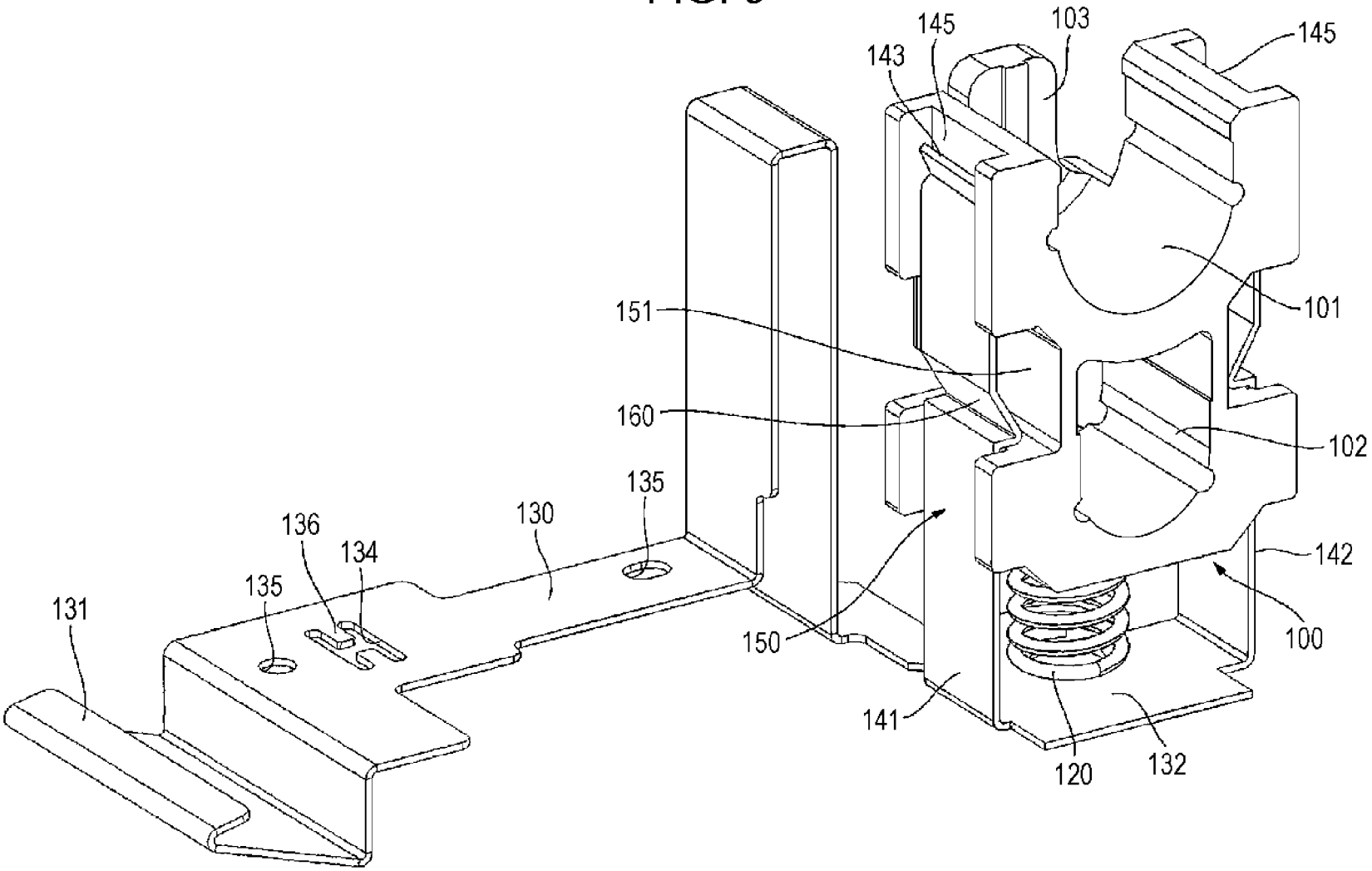
FIG. 9 is an overall perspective view of the power supply structure and the support structure for the charging device used in the first exemplary embodiment.

In the first exemplary embodiment, as illustrated in FIGS. 6 and 7, the charge housing 71 is provided with a power supply plate 130 that supplies power to the charging roller 72 and the cleaning roller 73. The power supply plate 130 is formed of metal such as SUS, and is appropriately folded along the shape of the charge housing 71. A part of the power supply plate 130 serves as a power supply contact piece 131 that is connectable to a connecting contact 28 connected to a power source on the apparatus body 21 side (see FIG. 2) when the process cartridge 30 is mounted in the cartridge receiving portion 27. Another part of the power supply plate 130 serves as a power supply contact piece 132 to be in contact with the pressing member 120. In the first exemplary embodiment, the connecting contact 28 is formed by an elastic spring, and comes into elastic contact with the power supply contact piece 131 of the power supply plate 130 when the process cartridge 30 is mounted in the cartridge receiving portion 27.

Since the power supply plate 130 needs to be arranged along a predetermined path on the charge housing 71, it has a positioning hole 134 to be fitted on a positioning catch boss 133 provided at an appropriate position of the charge housing 71, and a mounting hole 135 to be fixed by an unillustrated fastener. In the first exemplary embodiment, elastic holding pieces 136 are provided at edges of the positioning hole 134 so as to elastically hold the catch boss 133 that is fitted in the positioning hole 134.

In this way, in the first exemplary embodiment, power from the power supply plate 130 is supplied to the conductive bearing member 100 through the pressing member 120, and is then supplied to the charging roller 72 and the cleaning roller 73.

In particular, in the first exemplary embodiment, power is supplied to the charging roller 72 through the first bearing portion 101 and the block piece 103 of the bearing member 100, and is supplied to the cleaning roller 73 through the second bearing portion 102 and the block piece 104. Hence, the bearing member 100 more stably contacts with the charging roller 72 and the cleaning roller 73 than in a case in which the block pieces 103 and 104 are not provided.

Positioning Mechanism on Power Supplied Side

In the first exemplary embodiment, it is necessary to add a positioning mechanism 150 that positions the bearing member 100 at a predetermined holding position so that the charging roller 72 is kept out of contact with the photoconductor 31 when the charging device 32 is assembled in the charging device 32 or during maintenance of the process cartridge 30.

In the first exemplary embodiment, platelike or substantially platelike extending portions 141 and 142 opposing both side walls of the bearing member 100 stand in a folded manner from both sides of the power supply contact piece 132 of the power supply plate 130 in the width direction intersecting the axial direction of the bearing member 100. These extending portions 141 and 142 function as elastically deformable leaf springs.

The positioning mechanism 150 is provided at a position corresponding to each of the extending portions 141 and 142 of the power supply plate 130. The positioning mechanism 150 has a depressed or substantially depressed positioning portion 151 on a bearing member 100 side, and a projecting or substantially projecting positioned portion 160 on an extending portion 141 or 142 side.

In the first exemplary embodiment, the depressed positioning portion 151 is formed by a recess 152 of substantially trapezoidal cross section. An inner surface of the recess 152 on the pressing member 120 side is formed as a substantially horizontal positioning face 153. In contrast, an inner surface of the recess 152 on the photoconductor 31 side is formed as an inclined face 154 obliquely sloping from the horizontal direction. A bottom face of the recess 152 is formed as a substantially vertical face 155.

Figure 10:
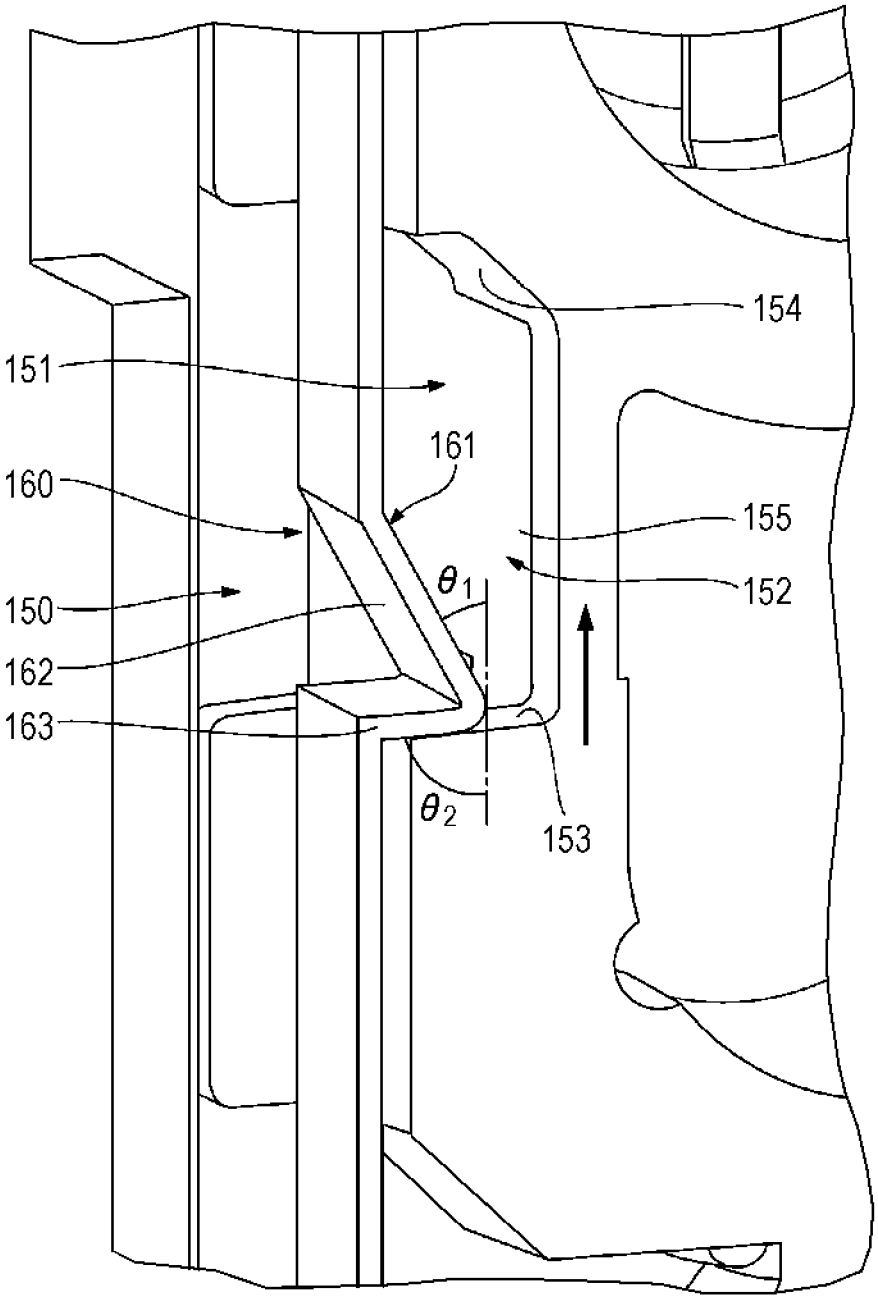
FIG. 10 illustrates the principal part of a positioning mechanism provided on a power supplied side of the charging device used in the first exemplary embodiment.

The projecting positioned portion 160 is formed by a projecting piece 161 obtained by folding a part of each of the platelike extending portions 141 and 142 in an angular form. For example, as illustrated in FIG. 10, an inclination angle $\theta_1$ of a projecting portion 162 of the projecting piece 161 located on a side opposite the pressing member 120 with respect to the pressing direction of the pressing member 120 is set to be smaller than an inclination angle $\theta_2$ of a projecting portion 163 on the opposite side with respect to the pressing direction. In the first exemplary embodiment, $\theta_1$ is about 30 to 45 degrees, and $\theta_2$ is about 90 degrees.

In the first exemplary embodiment, at the tips of the extending portions 141 and 142, open portions 143 opening to gradually separate from both side walls of the bearing member 100 are provided. The open portions 143 serve to guide the bearing member 100 into between the extending portions 141 and 142 when the bearing member 100 is assembled in the charge housing 71.

In addition, guide grooves 145 for clamping a pair of extending portions 141 and 142 are provided in both side walls of the bearing member 100 such as to pass through the recesses 152 of the positioning portions 151.

Bearing Member on Power Non-Supplied Side

Figure 11:
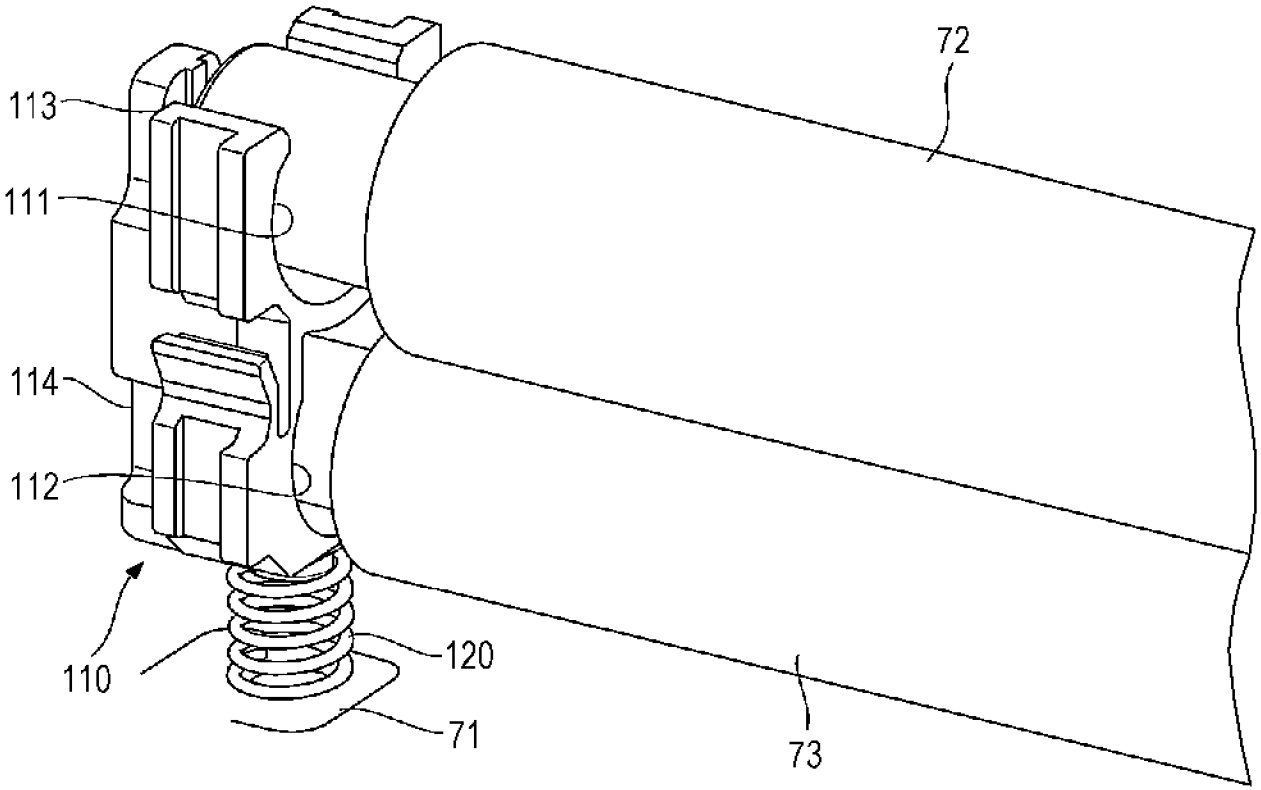
FIG. 11 is a perspective view illustrating the principal part of a support structure provided on a power non-supplied side of the charging device used in the first exemplary embodiment.
Figure 12:
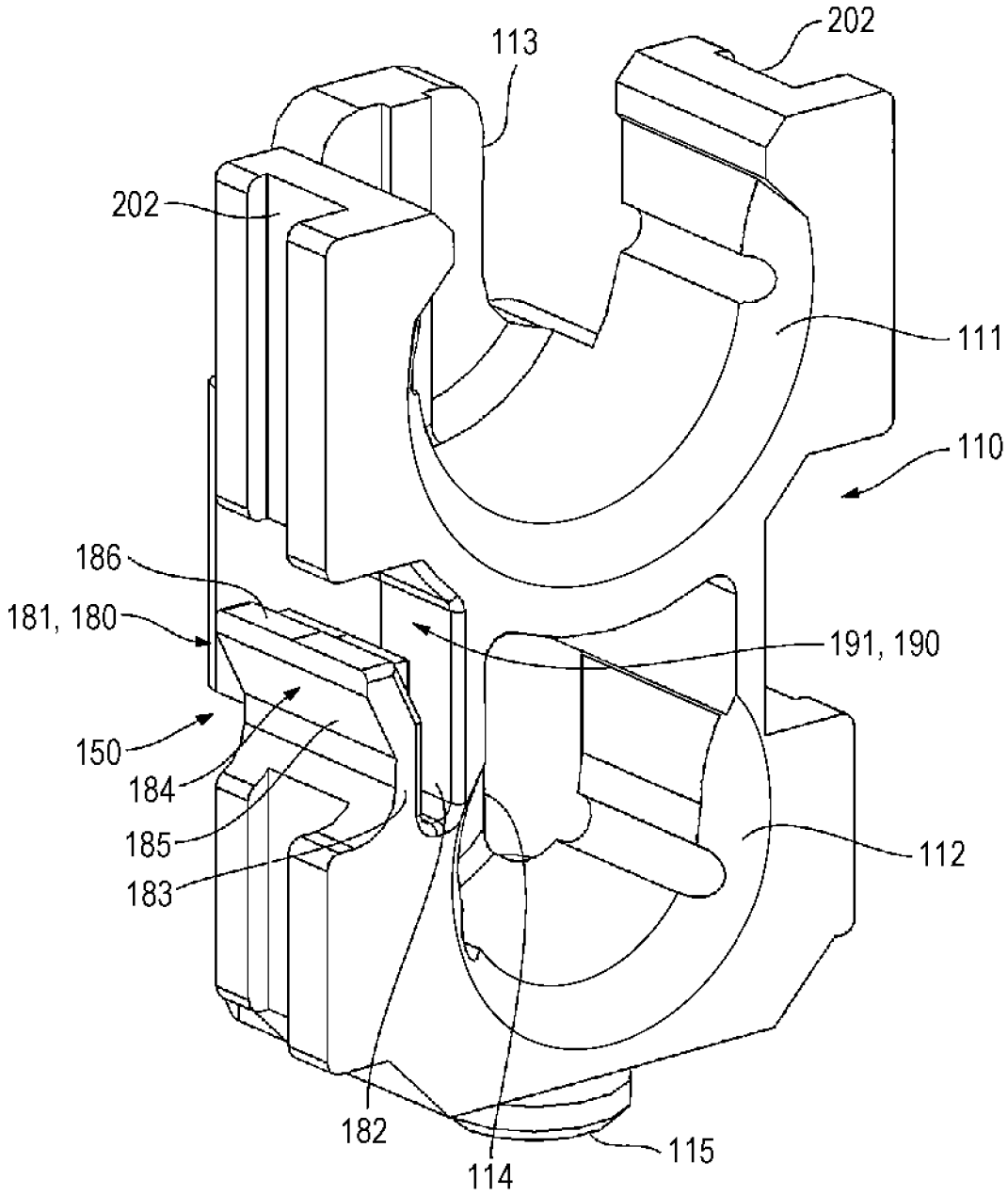
FIG. 12 is a detailed view of a bearing member illustrated in FIG. 11.
Figure 13:
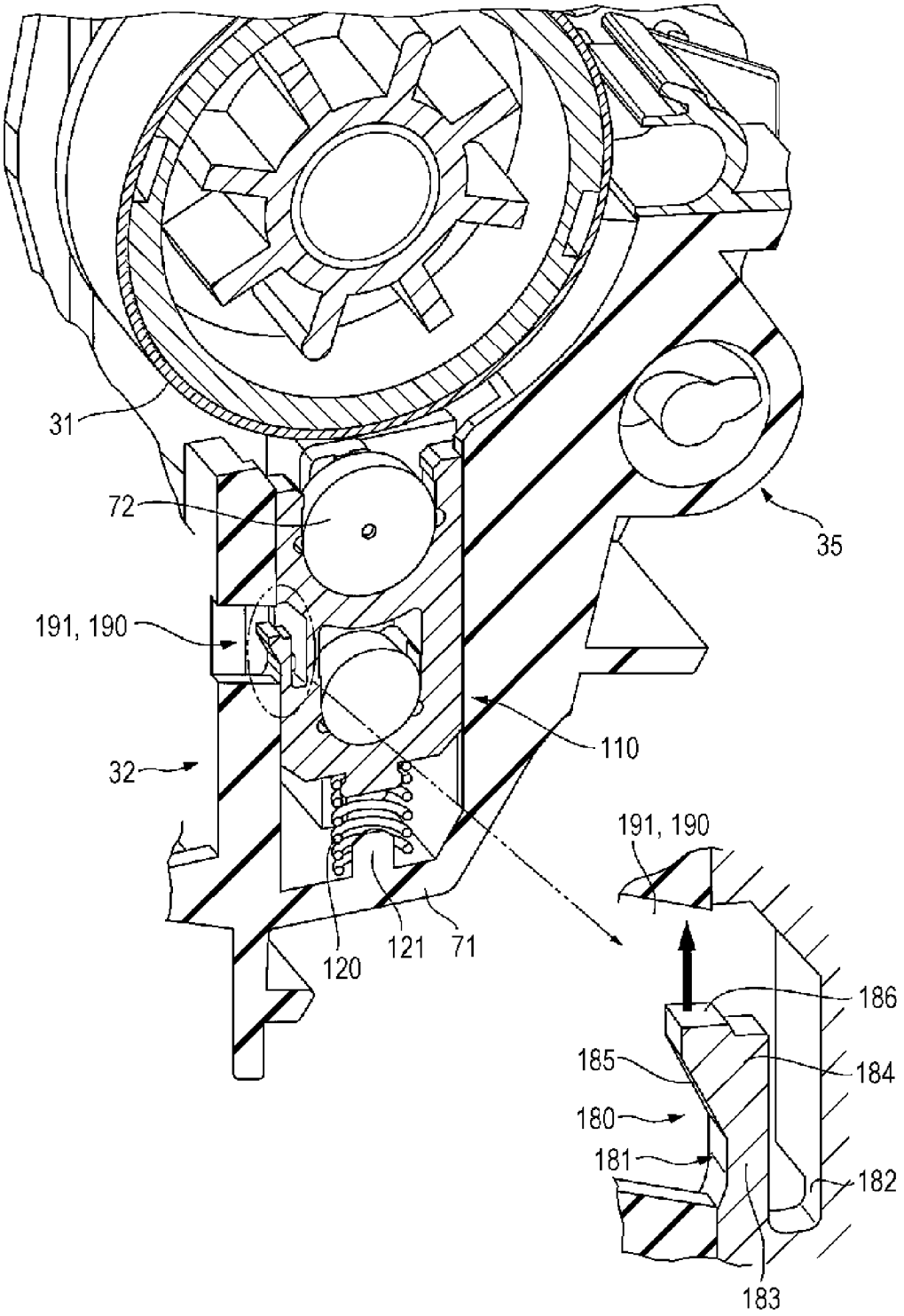
FIG. 13 illustrates the principal part of a positioning mechanism illustrated in FIG. 11.

Next, the bearing member 110 on the power non-supplied side will be described with reference to FIGS. 11 to 13.

In the first exemplary embodiment, the bearing member 110 on the power non-supplied side is formed of a nonconductive material such as synthetic resin (e.g., POM: polyacetal, polyoxymethylene). While the bearing member 110 has a base formed of synthetic resin similar to that of the bearing member 100 on the power supplied side, it does not contain a conductive material such as carbon. Hence, the bearing member 110 is obtained as a structure having an even higher durability than that of the bearing member 100 on the power supplied side.

Substantially similarly to the bearing member 100 on the power supplied side, the bearing member 110 has, in a portion opposing the photoconductor 31, a first bearing portion 111 shaped like a substantially U-shaped groove in which the other axial end of the charging roller 72 is supported. The bearing member 110 also has, on a pressing member 120 side of the first bearing portion 111, a second bearing portion 112 shaped like a hole in which the other axial end of the cleaning roller 73 is fitted and supported. From axial ends of the bearing portions 111 and 112 at one side, elastically deformable block pieces 103 and 104 integrally stand to block tips of the other axial ends of the charging roller 72 and the cleaning roller 73.

In addition, in the first exemplary embodiment, the pressing member 120 is formed by an elastic spring such as a coil spring. For this reason, a connecting pin 115 protrudes from a pressing member 120 side of the bearing member 110. One end of the pressing member 120 is fitted on and connected to the connecting pin 115. The other end of the pressing member 120 is fitted on a restraint pin 121 protruding from the charge housing 71 so that the pressing member 120 is restrained from being displaced from a predetermined position.

Positioning Mechanism on Power Non-Supplied Side

The bearing member 110 on the power non-supplied side also needs to have a positioning mechanism 150, similarly to the bearing member 100 on the power supplied side.

However, the positioning mechanism 150 on the power non-supplied side has a structure different from that of the positioning mechanism 150 on the power supplied side in that the power supply plate 130 is not provided.

In the first exemplary embodiment, the positioning mechanism 150 is provided between one side wall of the bearing member 110 and the opposing charge housing 71. The positioning mechanism 150 includes an elastically deformable and projecting or substantially projecting positioning portion 180 provided in a part of the bearing member 110, and a depressed or substantially depressed positioned portion 190 provided in a portion of the charge housing 71 corresponding to the positioning portion 180. The positioned portion 190 engages with the positioning portion 180 when the positioning portion 180 elastically deforms.

The positioning portion 180 is integrally provided with a catch piece 181 with a gap 182 being disposed therebetween. The catch piece 181 extends in the pressing direction of the pressing member 120, and is elastically deformable in the width direction of the bearing member 110 intersecting the pressing direction of the pressing member 120. The catch piece 181 includes an elastically deformable thin leg portion 183. On a photoconductor 31 side of the elastic leg portion 183, a head portion 184 thicker than the elastic leg portion 183 is provided. On a side of the head portion 184 opposite the gap 182, an inclined face 185 slopes to gradually open toward the photoconductor 31. At a distal end of the head portion 184, a positioning face 186 extends in a substantially horizontal direction.

In contrast, the positioned portion 190 has a positioned hole 191 opening in correspondence with the catch piece 181 of the positioning portion 180. A portion of the head portion 184 of the catch piece 181 in the positioning portion 180, which projects from the elastic leg portion 183 toward the charge housing 71, enters the positioned hole 191, and the positioning face 186 of the catch piece 181 abuts on a photoconductor 31 side edge of the positioned hole 191.

Relationship Between Bearing Members and Charge Housing

Next, the relationship between the bearing members 100 and 110 and the charge housing 71 will be described with reference to FIGS. 14A and 14B.

Figure 14A:
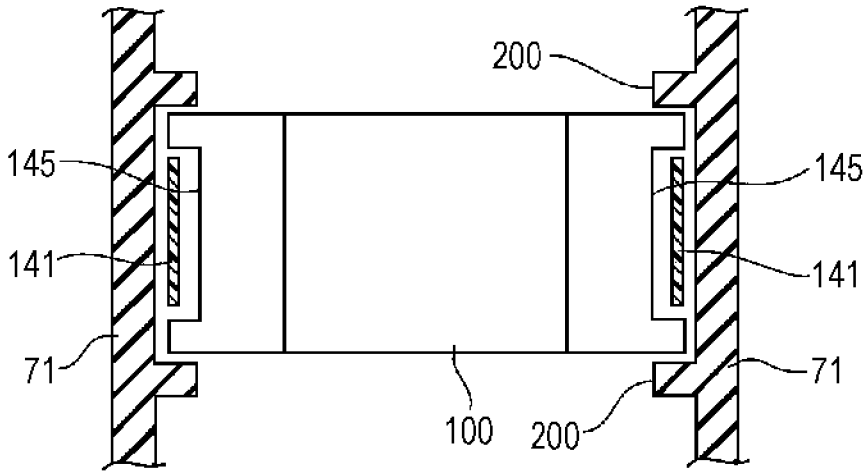
FIG. 14A illustrates an exemplary structure for holding a bearing member provided on the power supplied side in a charge housing.

First, as illustrated in FIG. 14A, guide grooves 200 are provided in portions of the charge housing 71 opposing both side walls of the bearing member 100 on the power supplied side. The guide grooves 200 extend in the pressing direction of the pressing member 120. The bearing member 100 is guided and held with its side walls being clamped in the guide grooves 200.

Figure 14B:
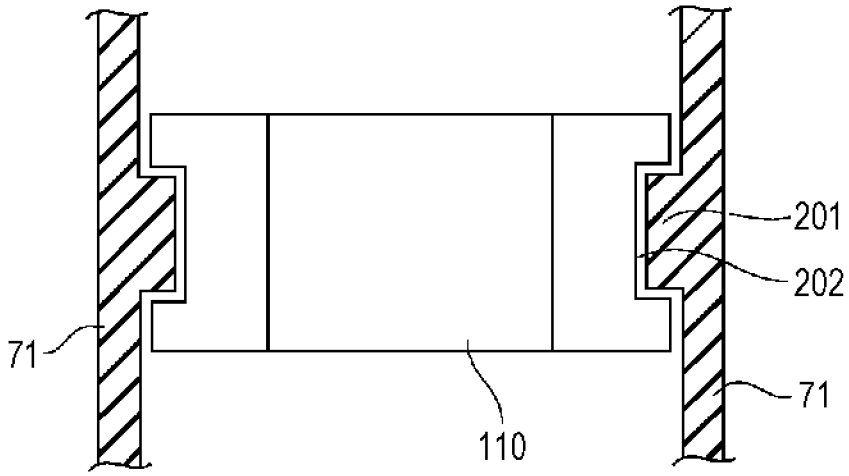
FIG. 14B illustrates an exemplary structure for holding a bearing member provided on the power non-supplied side in the charge housing.

In contrast, as illustrated in FIG. 14B, guide ribs 201 are provided in portions of the charge housing 71 opposing both side walls of the bearing member 110 on the power non-supplied side. The guide ribs 201 extend in the pressing direction of the pressing member 120. In portions of the bearing member 110 opposing the guide ribs 201, guide grooves 202 are provided such that the guide ribs 201 are movably fitted therein. The bearing member 110 is guided and held while the guide ribs 201 are fitted in the guide grooves 202.

Next, a description will be given of a mounting state of the charging device 32 in the first exemplary embodiment.

To assemble the charging device 32 in the process cartridge 30, first, the bearing members 100 and 110, to which the pressing members 120 are attached beforehand, are mounted at predetermined positions of the restraint pins 121 of the charge housing 71, and the bearing members 100 and 110 are positioned and held by the respective positioning mechanisms 150.

In this case, in the positioning mechanism 150 on the power supplied side, when the bearing member 100 is inserted while being clamped between the extending portions 141 and 142, the leading end of the bearing member 100 comes into contact with the small-angle projecting portions 162 of the angular projecting pieces 161 serving as the positioned portions 160 of the extending portions 141 and 142. With this, the extending portions 141 and 142 are pushed open outward by elastic deformation. When the projecting pieces 161 reach the recesses 152 of the positioning portions 151, they are received in the recesses 152 by elastic deformation of the extending portions 141 and 142.

Since the pressing force of the pressing member 120 acts on the bearing member 100 in this state, the bearing member 100 is pressed toward the photoconductor 31 by the pressing force of the pressing member 120. However, the positioning portions 151 engage with the positioned portions 160, and the projecting portions 163 having a large inclination angle in the projecting pieces 161 of the positioned portions 160 come into contact with the positioning faces 153 of the recesses 151 in the positioning portions 151, so that the bearing member 100 is positioned.

In contrast, in the positioning mechanism 150 on the power non-supplied side, when the bearing member 110 is inserted while being clamped in the charge housing 71, the catch piece 181 serving as the positioning portion 180 in the bearing member 110 comes into contact with the wall surface of the charge housing 71, and is moved by elastic deformation while temporarily retracting in the gap 182. When the catch piece 181 reaches the positioned hole 191 in the positioned portion 190, it elastically deforms to be received in the positioned hole 191.

Since the pressing force of the pressing member 120 acts on the bearing member 110 in this state, the bearing member 110 is pressed toward the photoconductor 31 by the pressing force of the pressing member 120. However, the positioning portion 180 engages with the positioned portion 190, and the positioning face 186 of the positioning portion 180 comes into contact with an edge of the positioned hole 191 of the positioning portion 190, so that the bearing member 110 is positioned.

In this case, when the photoconductor 31 comes into contact with or adjacent to the charging roller 72, the charging roller 72 is pushed by the photoconductor 31, and the positioning mechanisms 150 of the bearing members 100 and 110 move from their positions and are pressed against the photoconductor 31 with a desired pressure by the pressing forces of the pressing members 120.

In the bearing member 100 on the power supplied side, power supplied from the power supply plate 130 is supplied to the charging roller 72 and the cleaning roller 73 through the pressing member 120 and the bearing member 100.

During maintenance of the process cartridge 30, the charging roller 72 and the cleaning roller 73 are removed from the charge housing 71 together with the bearing members 100 and 110. In the positioning mechanism 150 in the conductive bearing member 100, positioning may be easily released by utilizing the elastic action of the extending portions 141 and 142 serving as the parts of the power supply plate 130. Hence, if the conductive bearing member 100 is formed of a material having low durability, it will not be broken unnecessarily.

In contrast, in the positioning mechanism 150 of the bearing member 110, the bearing member 110 has the catch piece 181 serving as the positioning portion 180. Since the bearing member 110 is formed of a material having high durability, positioning is released by elastic deformation of the catch piece 181, but the catch piece 181 will not be broken unnecessarily.

While the charging device 32 includes the cleaning roller 73 in the first exemplary embodiment, in a case in which the charging device 32 does not include the cleaning roller 73, the bearing member 100 and 110 do not need to have second bearing portions for the cleaning roller 73.

Second Exemplary Embodiment

Figure 15:
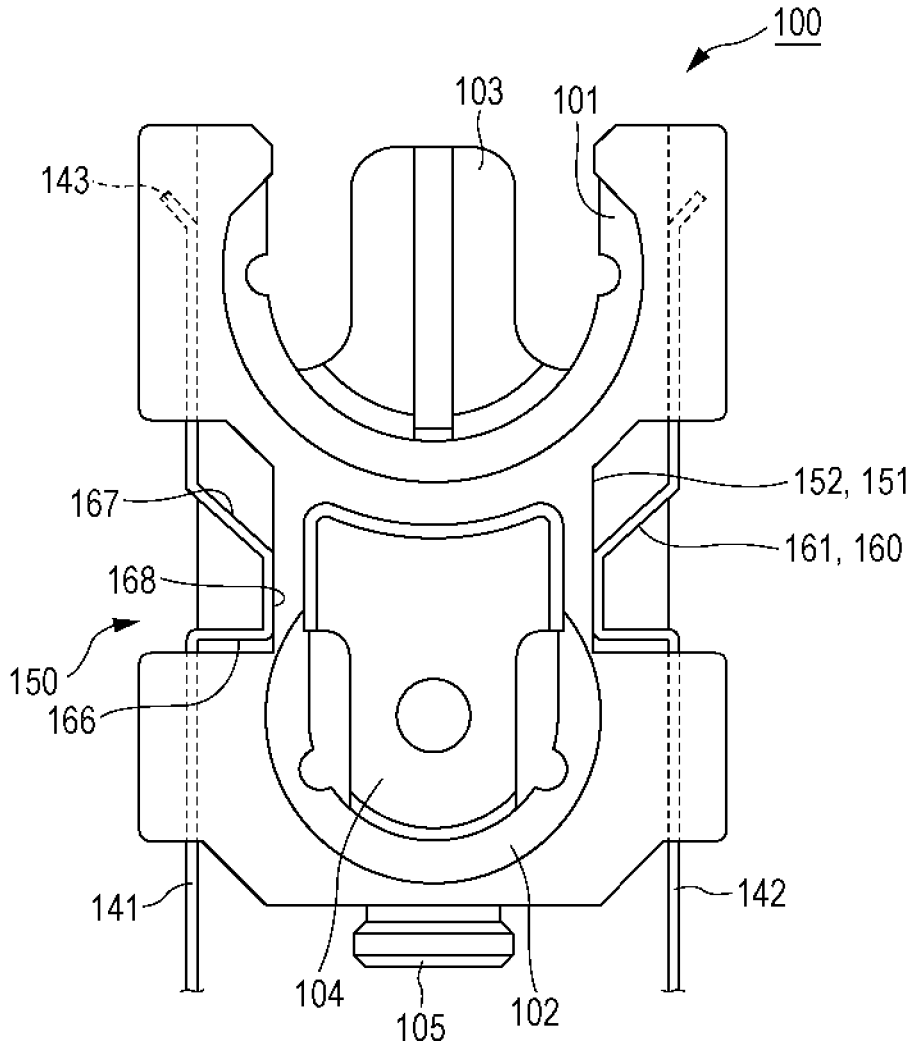
FIG. 15 illustrates the principal part of a positioning mechanism provided on a power supplied side of a charging device according to a second exemplary embodiment.

FIG. 15 illustrates the principal part of a positioning mechanism 150 on a power supplied side in a second exemplary embodiment.

Referring to FIG. 15, the positioning mechanism 150 on the power supplied side basically has recesses 152 serving as positioning portions 151 in a bearing member 100, substantially similar to the first exemplary embodiment, whereas it is different from the first exemplary embodiment in positioned portions 160 of extending portions 141 and 142.

The positioned portions 160 are formed by projecting pieces 161 of trapezoidal cross section. The projecting pieces 161 include positioned faces 166 opposing positioning faces 153 of the recesses 152 of the positioning portions 151, inclined faces 167 inclined with respect to the pressing direction of the pressing member 120, and substantially vertical contact faces 168 opposing vertical faces 155 of the recesses 152.

For this reason, in the second exemplary embodiment, similarly to the first exemplary embodiment, the bearing member 100 on the power supplied side is placed at a desired position before the process cartridge 30 is mounted, and a charging roller 72 is pressed against a photoconductor 31 with a desired pressure by the pressing member 120 after the process cartridge 30 is mounted. In this state, power supplied from a power supply plate 130 is supplied to the bearing member 100 via a power supply contact piece 132 normally serving as a first contact and the pressing member 120. Moreover, contact portions between the positioning portions 151 and the positioned portions 160 (vertical faces 155, contact faces 168) in the positioning mechanism 150 may be used as a second contact.

Third Exemplary Embodiment

Figure 16:
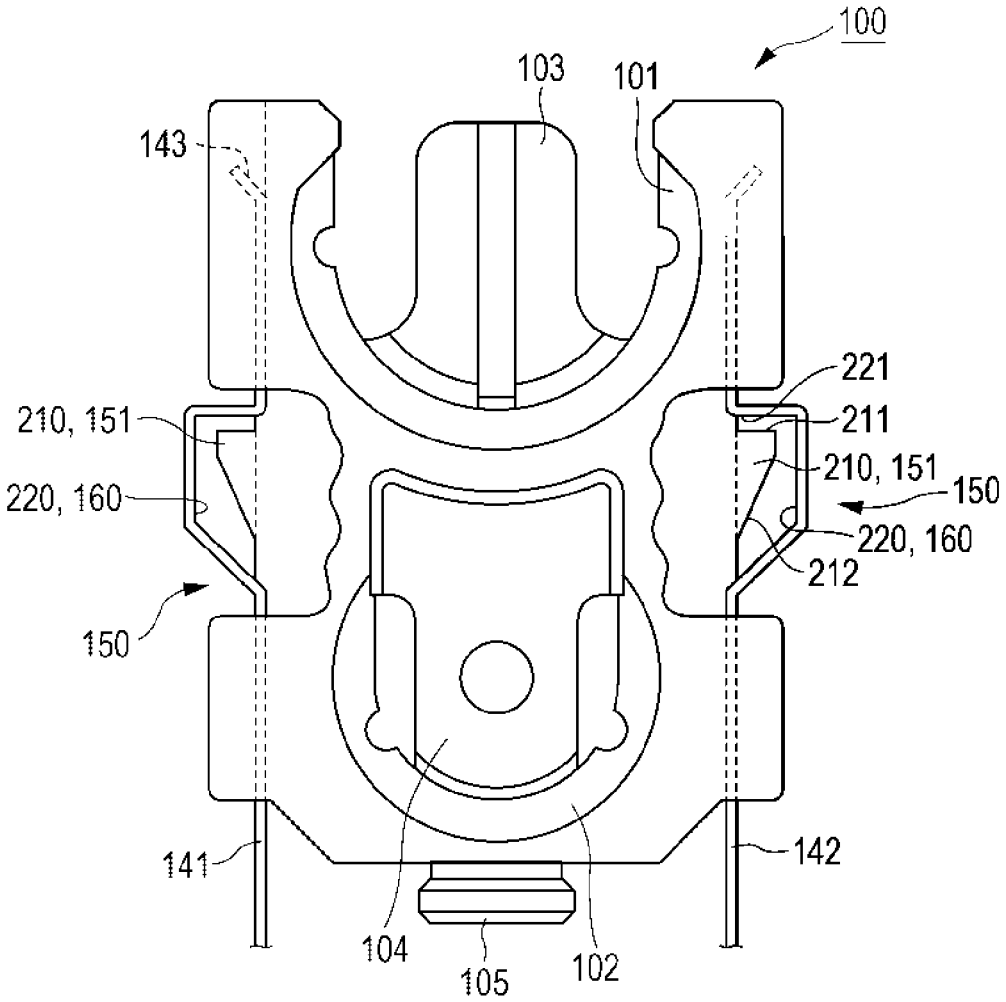
FIG. 16 illustrates the principal part of a positioning mechanism provided on a power supplied side of a charging device according to a third exemplary embodiment.

FIG. 16 illustrates the principal part of a positioning mechanism 150 on a power supplied side used in a third exemplary embodiment.

Referring to FIG. 16, a basic structure of the positioning mechanism 150 on the power supplied side is different from that adopted in the first exemplary embodiment. That is, a bearing member 100 has projections 210 serving as positioning portions 151, and extending portions 141 and 142 have recesses 220 serving as positioned portions 160. Structures similar to those adopted in the first exemplary embodiment are denoted by the same reference numerals as those in the first exemplary embodiment, and detailed descriptions thereof are skipped here.

In the third exemplary embodiment, to position the bearing member 100, the projections 210 serving as the positioning portions 151 have positioning faces 211 on a photoconductor 31 side, and inclined faces 212 sloping in the pressing direction on a pressing member 120 side. In contrast, the recesses 220 serving as the positioned portions 160 have positioned faces 221 in portions corresponding to the positioning faces 211 of the projections 210.

Fourth Exemplary Embodiment

Figure 17:
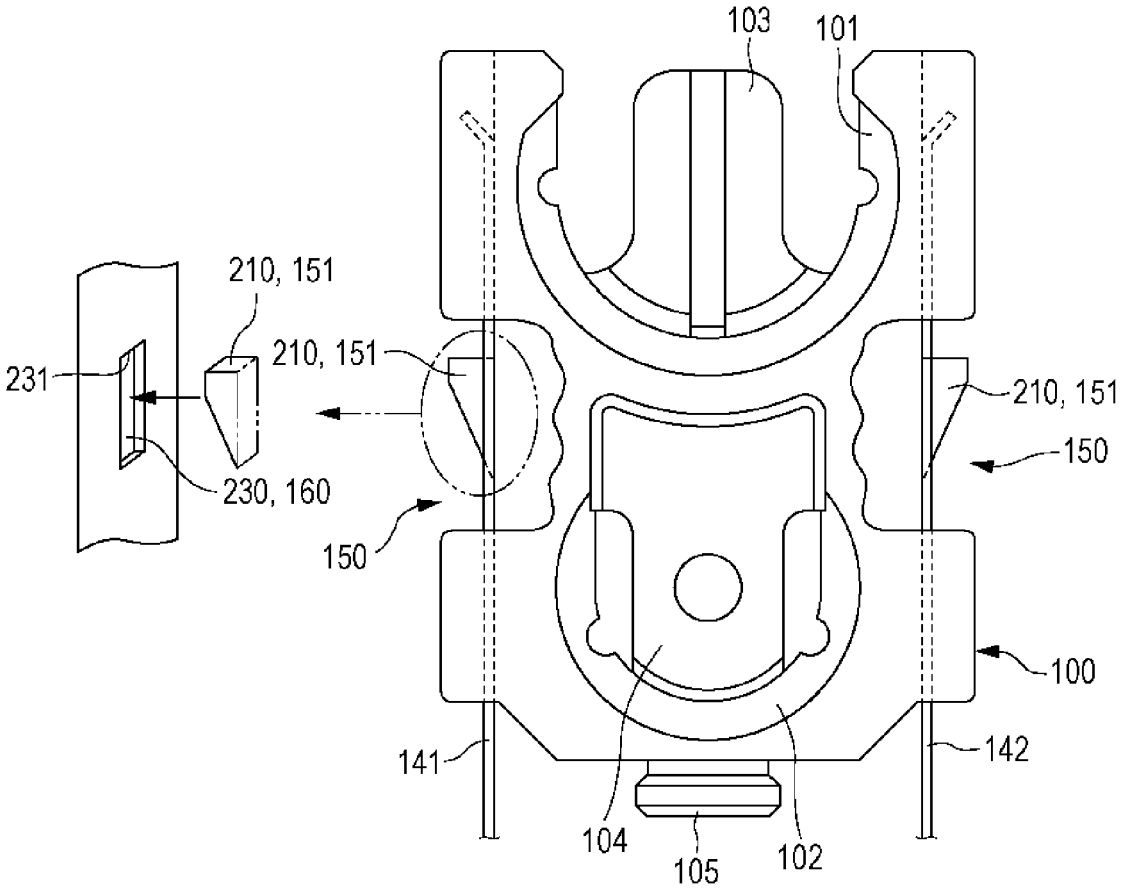
FIG. 17 illustrates the principal part of a positioning mechanism provided on a power supplied side of a charging device according to a fourth exemplary embodiment.

FIG. 17 illustrates the principal part of a positioning mechanism 150 on a power supplied side used in a fourth exemplary embodiment.

Referring to FIG. 17, the basic structure of the positioning mechanism 150 on the power supplied side is substantially identical to that adopted in the third exemplary embodiment. However, unlike the third exemplary embodiment, positioned holes 230 are provided in a charge housing 71, instead of the recesses 220 serving as the positioned portions 160.

The shape of the positioned holes 230 may be appropriately determined in accordance with the shape of projections 210 serving as positioning portions 151. In the fourth exemplary embodiment, since positioning faces 211 of the projections 210 are flat, the positioned holes 230 are formed by rectangular holes extending in the pressing direction of a pressing member 120. Edges of the positioned holes 230 function as positioned faces 231 with which the positioning faces 211 of the projections 210 contact.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member opposing a charged body to be charged, the charging member being provided in contact with or adjacent to the charged body;

a charge housing that holds the charging member;

bearing members provided in the charge housing to rotatably support both axial ends of the charging member, at least one of the bearing members being a conductive bearing member formed of a conductive material;

pressing members provided in the charge housing to press the bearing members toward the charged body, at least the pressing member that presses the conductive bearing member being formed of a conductive material;

a substantially platelike power supply member fixed to the charge housing and provided in contact with the pressing member corresponding to the conductive bearing member so as to supply power to the charging member via the pressing member and the conductive bearing member; and positioning mechanisms that position the bearing members pressed by the pressing members at a predetermined holding position relative to the charge housing so that the bearing members do not fall off, wherein the power supply member has an elastically deformable and substantially platelike extending portion extending to a position opposing the conductive bearing member, and wherein the positioning mechanism provided on a power supplied side of the charging member includes a substantially depressed or projecting positioning portion provided in a portion of the conductive bearing member opposing the extending portion, and a substantially projecting or depressed positioned portion provided in a portion of the extending portion corresponding to the positioning portion, the positioned portion engaging with the positioning portion when the extending portion elastically deforms, wherein the positioning mechanism located on the power supplied side of the charging member includes a substantially depressed positioning portion provided in the conductive bearing member, and a substantially projecting positioned portion provided in the extending portion, wherein the substantially projecting positioned portion is formed by a projecting piece obtained by folding a part of the extending portion in an angular form, and wherein an inclination angle of a portion of the projecting piece on a side to be pressed by the pressing member with respect to a pressing direction of the pressing member is set to be smaller than an inclination angle of a portion of the projecting piece located on an opposite side with respect to the pressing direction of the pressing member.

2. The charging device according to claim 1, wherein a plurality of the extending portions are provided to oppose the conductive bearing member, and wherein the positioning mechanism opposing the conductive bearing member is provided between the conductive bearing member and each of the plurality of extending portions.

3. The charging device according to claim 1, wherein the positioning mechanism located on a power non-supplied side of the charging member includes an elastically deformable and substantially projecting positioning portion provided in a part of the corresponding bearing member, and a substantially depressed positioned portion provided in a portion of the charge housing corresponding to the positioning portion, the positioned portion engaging with the positioning portion when the positioning portion elastically deforms.

4. An image forming assembly comprising:

a charged body to be charged when an image is formed;

the charging device according to claim 1 that charges the charged body; and a housing including the charge housing of the charging device so as to hold the charged body, wherein the image forming assembly is detachably mounted in an image forming apparatus body.

5. An image forming apparatus including an image forming apparatus body in which the image forming assembly according to claim 4 is mounted detachably.

6. An image forming apparatus comprising:

a charged body to be charged when an image is formed; and the charging device according to claim 1 that charges the charged body.

7. A charging device comprising:

a charging member opposing a charged body to be charged, the charging member being provided in contact with or adjacent to the charged body;

a charge housing that holds the charging member;

bearing members provided in the charge housing to rotatably support both axial ends of the charging member, at least one of the bearing members being a conductive bearing member formed of a conductive material;

pressing members provided in the charge housing to press the bearing members toward the charged body, at least the pressing member that presses the conductive bearing member being formed of a conductive material;

a substantially platelike power supply member fixed to the charge housing and provided in contact with the pressing member corresponding to the conductive bearing member so as to supply power to the charging member via the pressing member and the conductive bearing member; and positioning mechanisms that position the bearing members pressed by the pressing members at a predetermined holding position relative to the charge housing so that the bearing members do not fall off, wherein the power supply member has an elastically deformable and substantially platelike extending portion extending to a position opposing the conductive bearing member, and wherein the positioning mechanism provided on a power supplied side of the charging member includes a substantially depressed or projecting positioning portion provided in a portion of the conductive bearing member opposing the extending portion, and a substantially projecting or depressed positioned portion provided in a portion of the extending portion corresponding to the positioning portion, the positioned portion engaging with the positioning portion when the extending portion elastically deforms, wherein, in the positioning mechanism on the power supplied side of the charging member, the positioning portion and the positioned portion are in contact with each other in a direction intersecting a pressing direction of the pressing member when the charging member is located in contact with or adjacent to the charged body.

* * * * *